US011472181B2

(12) United States Patent
Kanzaki

(10) Patent No.: US 11,472,181 B2
(45) Date of Patent: Oct. 18, 2022

(54) LIQUID EJECTION HEAD

(71) Applicant: Brother Kogyo Kabushiki Kaisha, Aichi-Ken (JP)

(72) Inventor: Shotaro Kanzaki, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 4 days.

(21) Appl. No.: 17/177,553

(22) Filed: Feb. 17, 2021

(65) Prior Publication Data

US 2021/0252856 A1 Aug. 19, 2021

(30) Foreign Application Priority Data

Feb. 17, 2020 (JP) ..... JP2020-024595

(51) Int. Cl.
*B41J 2/14* (2006.01)
*B41J 2/03* (2006.01)

(52) U.S. Cl.
CPC . *B41J 2/14* (2013.01); *B41J 2/03* (2013.01); *B41J 2002/14419* (2013.01); *B41J 2002/14467* (2013.01); *B41J 2002/14483* (2013.01)

(58) Field of Classification Search
CPC ..... B41J 2/14; B41J 2/03; B41J 2002/14419; B41J 2002/14467; B41J 2002/14483; B41J 2002/14306; B41J 2202/12; B41J 2/14233
See application file for complete search history.

(56) References Cited

U.S. PATENT DOCUMENTS 11,104,131 B2 8/2021 Ikeuchi et al.
2017/0253037 A1* 9/2017 Kobayashi ..... B41J 2/18

FOREIGN PATENT DOCUMENTS

JP 2008-290292 A 12/2008
WO 2016-031920 A1 3/2016

OTHER PUBLICATIONS

IP.com search (Year: 2022).*

* cited by examiner

*Primary Examiner* — Lisa Solomon
(74) *Attorney, Agent, or Firm* — Banner & Witcoff, Ltd.

(57) ABSTRACT

A liquid ejecting head includes a channel forming body including a plurality of individual channels, a first manifold and a second manifold. The plurality of individual channels includes: a nozzle; a pressure chamber which is arranged to be apart from the nozzle in a first direction; a descender communicating the pressure chamber and the nozzle with each other, and extending in the first direction; a return channel including a first return channel and a second return channel, extending in a direction crossing the first direction, and having one end connected to the descender; and a communicating channel including a first communicating channel, and connecting the other end of the return channel to the second manifold. The first communicating channel connects the first return channel to the second manifold and connects the second return channel to the second manifold.

18 Claims, 5 Drawing Sheets

LIQUID EJECTION HEAD

CROSS REFERENCE TO RELATED APPLICATION

The present application claims priority from Japanese Patent Application No. 2020-024595, filed on Feb. 17, 2020, the disclosure of which is incorporated herein by reference in its entirety.

BACKGROUND

Field of the Invention

The present disclosure relates to a liquid ejecting head.

Description of the Related Art

As a conventional liquid ejecting head, a liquid ejecting head of International Publication No. WO2016/031920 corresponding to United State Patent Application Publication No. US 2017/0253037 is known. The liquid ejecting head includes a plurality of channels each of which includes an ejecting hole and a pressurizing chamber which communicates with the ejecting hole. Each of the plurality of channels is connected to a secondary recovery channel via an individual recovery channel. Individual recovery channels of mutually adjacent channels, among the plurality of individual channels, are connected by a connecting channel.

In the liquid ejecting head of International Publication No. WO2016/031920, since there is no difference in the pressures between the adjacent channels, the liquid scarcely flows to (through) the connecting channel. Therefore, in a case that the ink is introduced into each of the plurality of channels, the ink hardly flows into the connecting channel, and an air bubble stays in the connecting channel. In a case that this air bubble flows from the connecting channel to the individual recovery channel, the resonance frequency of the individual channel changes, which in turn changes the ejecting performance of the channel connected to the individual channel. As a result, there is such a fear that the volume of a liquid droplet of the liquid ejected or discharged from the ejecting hole might be changed, and/or that the waveform control of a driving signal for ejecting the liquid droplet might be too late for the ejection (discharge). In such a case, any wrinkle or line is generated in a recording medium due to too much amount of the liquid droplet ejected and/or liquid droplets ejected from different nozzles overlapping on the recording medium. Further, due to such a situation that the amount of the liquid droplet is too small, and/or that the position of a dot formed by the liquid droplet on the recording medium is deviated, any dot omission might be generated.

The present disclosure has been made to solve the above-mentioned problems, and an object of the present disclosure is to provide a liquid ejecting head capable of suppressing any ejection failure (unsatisfactory ejection) due to the air bubble.

SUMMARY

According to an aspect of the present disclosure, there is provided a liquid ejecting head including a channel forming body including a plurality of individual channels, a first manifold and a second manifold, wherein the plurality of individual channels are connected to the first manifold and the second manifold, wherein the plurality of individual channels includes:

at least one nozzle, at least one pressure chamber which is arranged to be apart from the at least one nozzle in a first direction, and which communicates with the first manifold, at least one descender communicating the at least one pressure chamber and the at least one nozzle with each other, and extending in the first direction, at least one return channel extending in a direction crossing the first direction, and having one end connected to the at least one descender, and at least one communicating channel connecting the other end of the at least one return channel to the second manifold;

the at least one return channel includes a first return channel and a second return channel which are adjacent to each other in a second direction orthogonal to the first direction; and the at least one communicating channel includes a first communicating channel which connects the first return channel to the second manifold and connects the second return channel to the second manifold.

DESCRIPTION OF THE EMBODIMENTS

In the following, an embodiment of present disclosure will be explained in detail, with reference to the drawings.

First Embodiment

<Configuration of Liquid Ejecting Apparatus>

A liquid ejecting apparatus 10 provided with a liquid ejecting head (hereinafter referred to as a "head") 20 relating to a first embodiment of the present disclosure is an apparatus which ejects or discharges a liquid. In the following, although the liquid ejecting apparatus 10 will be explained as an example in which the liquid ejecting apparatus 10 is applied to an ink-jet printer using a liquid such as an ink, the present invention is not limited to this example.

Figure 1:
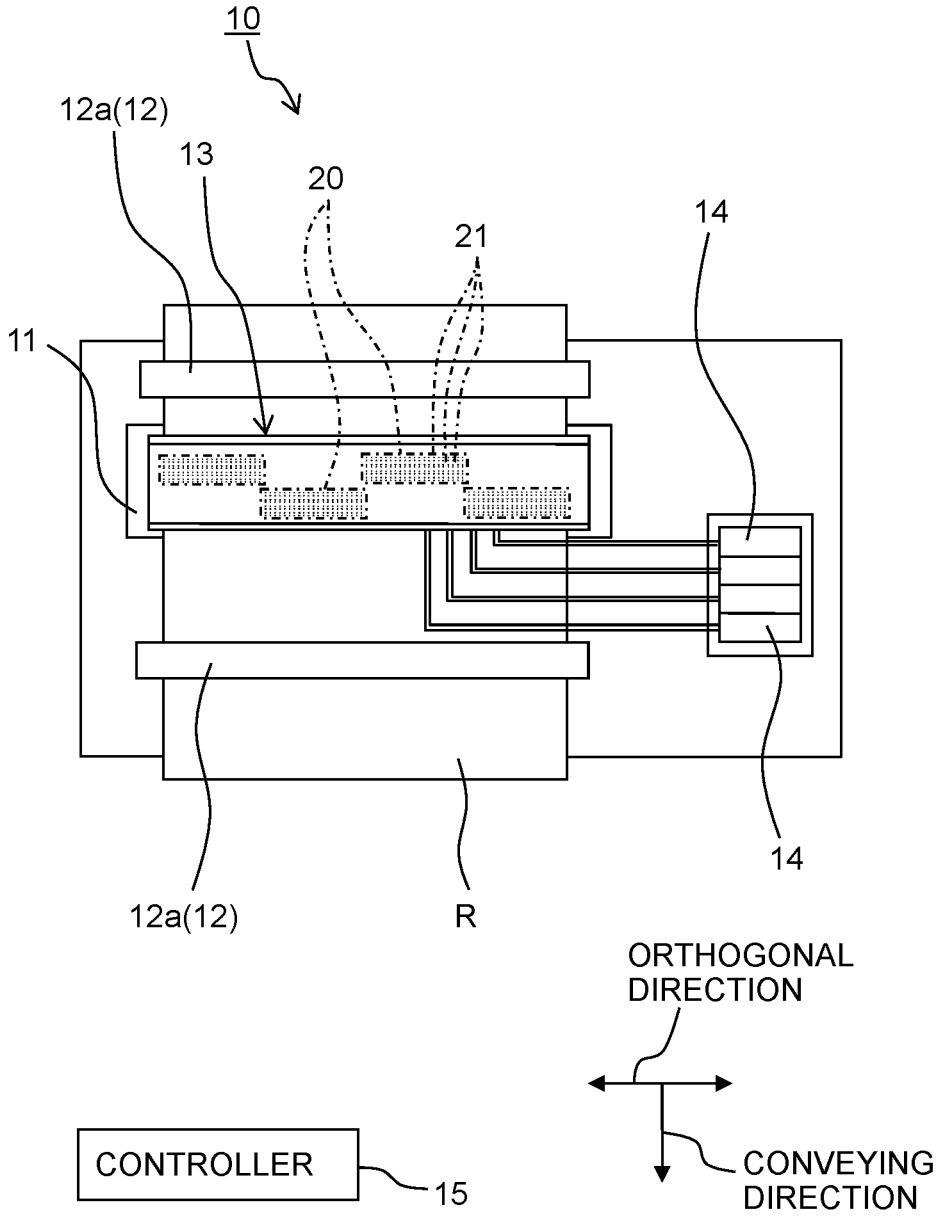
FIG. 1 is a view schematically depicting a liquid ejecting apparatus including a liquid ejecting head according to a first embodiment of the present disclosure.

As depicted in FIG. 1, the liquid ejecting apparatus 10 adopts the line head system, and includes a platen 11, a conveying part 12, a head unit 13, a storing tank 14 and a controller 15. However, the system adopted in the liquid ejecting apparatus 10 is not limited to the line head system, and other methods such as, for example, the serial head system may be adopted.

The platen 11 is a flat plate member; a recording medium R such as paper, etc., is placed on the upper surface of the platen 11, and the platen 11 determines the distance between the recording medium R and the head 20. The conveying part 12 includes, for example, two conveying rollers 12*a* and a conveying motor (not depicted in the drawings). The two conveying rollers 12*a* sandwich the platen 11 therebetween in a conveying direction in which the recording medium R is conveyed, are arranged parallel to each other, and are connected to the conveying motor. In a case that the conveying motor is driven, the conveying rollers 12*a* rotate and the recording medium R on the platen 11 is thereby conveyed in the conveying direction.

The head unit 13 has a length which is not less than a length, of the recording medium R, in a direction (orthogonal direction) orthogonal to the conveying direction. The head unit 13 is provided with a plurality of pieces of the head 20; and the plurality of heads 20 are arranged or aligned in the orthogonal direction. Each of the plurality of heads 20 has a plurality of nozzles 21 and a driving element 24 (see FIG. 2), and the plurality of nozzles 21 are opened in a lower surface (nozzle surface) of each of the plurality of heads 20. In a case that the driving element 24 is driven, the meniscus at the opening of each of the plurality of nozzles 21 is vibrated, and the liquid is ejected or discharged. Note that the details of the head 20 will be described later on.

The storing tank 14 is provided for each type of the liquid. For example, liquids (inks) of black, yellow, cyan and magenta are stored in four pieces of the storing tank 14, respectively. Each of the liquids in these storing tanks 14 is supplied to nozzles 21, among the plurality of nozzles 21, corresponding thereto.

The controller 15 includes an operation part such as a CPU, etc.; a storing part such as a RAM and ROM, etc.; and a driving part such as a ASIC, etc.; and is connected to a driver IC. In the controller 15, the CPU stores a variety of kinds of data in the RAM in response to a detection signal of a sensor and a variety of kinds of requests, and the CPU outputs a variety of kinds of executing instructions to the ASIC based on a program stored in the ROM. Based on this instruction, the ASIC controls the respective driver IC and executes an operation corresponding to each of the instructions. This drives the driving element 24 (see FIG. 2) of the head 20 and the conveying motor (not depicted in the drawings) of the conveying part 12.

For example, the controller 15 executes an ejecting operation of the liquid by the head 20, a conveying operation of the recording medium R by the conveying part 12, etc. In the ejecting operation, the liquid is ejected from the nozzles 21 of the head 20, and an image is formed on the recording medium R with the liquid. In the conveying operation, the recording medium R is conveyed in the conveying direction by a predetermined amount. As a result, images are arranged side by side in the conveying direction on the recording medium R, and a printing processing advances.

Note that in the following explanation, an up-down direction (first direction) is defined with a state that the liquid ejecting apparatus 10 is placed to be usable (a state depicted in FIG. 1) as the reference. Further, a direction in which the plurality of nozzles 21 are aligned in the nozzle surface is defined as a left-right direction (second direction). The left-right direction (second direction) is orthogonal to the up-down direction (first direction). Furthermore, a direction orthogonal to the up-down direction (first direction) and the left-right direction (second direction) is defined as a front-rear direction (third direction). The left-right direction (second direction) and the front-rear direction (third direction) are same as (parallel to) the orthogonal direction and the conveying direction, respectively, depicted in FIG. 1. In the state that the liquid ejecting apparatus 10 is placed to be usable (the state of FIG. 1), the downstream side in the conveying direction (the front-rear direction, the third direction) of the liquid ejecting apparatus 10 is defriend as "front" of the front-rear direction, and the upstream side in the conveying direction of the liquid ejecting apparatus 10 is defined as "rear" of the front-rear direction. Further, in a case that the liquid ejecting apparatus 10 is seen from the front (seen from the downstream side in the conveying direction) in the state that the liquid ejecting apparatus 10 is placed to be usable (the state of FIG. 1), the right side is defined as "right" of the left-right direction, and the left side is defined as "left" of left-right direction. Note that in the present embodiment, although the left-right direction is same as the orthogonal direction depicted in FIG. 1, the left-right direction is not limited by or restricted to this. The left-right direction is a direction crossing the up-down direction, and may be parallel to the orthogonal direction of FIG. 1, or may be inclined with respect to the orthogonal direction. In the present embodiment, although the front-rear direction is same as the conveying direction depicted in FIG. 1, the front-rear direction is not limited by or restricted to this. The front-rear direction is a direction crossing the up-down direction and the left-right direction, and may be parallel to the conveying direction of FIG. 1, or may be inclined with respect to the conveying direction.

<Configuration of Head>

Figure 2:
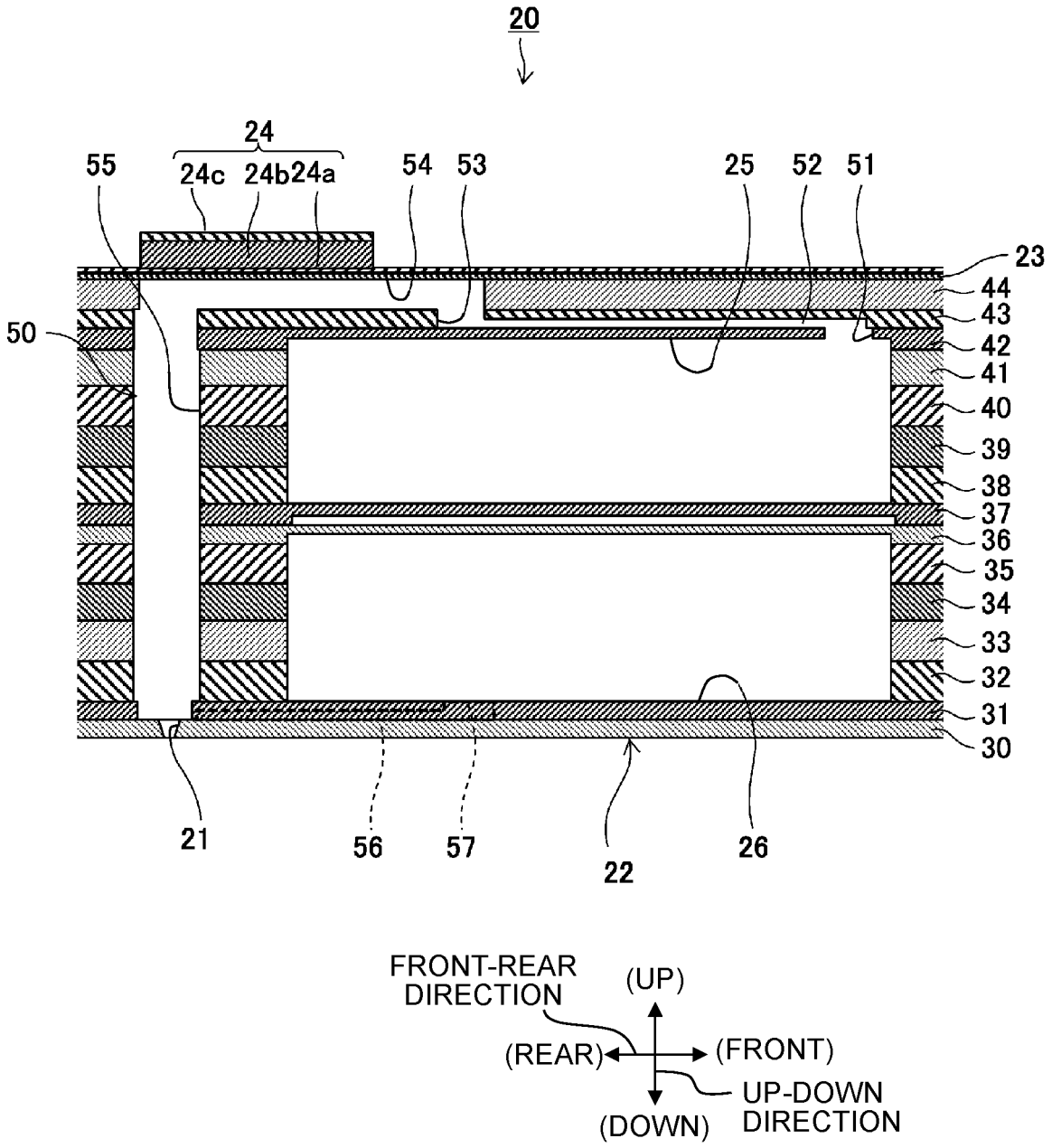
FIG. 2 is a cross-sectional view cutting the liquid ejecting head of FIG. 1 in a cross section orthogonal to a left-right direction.

As depicted in FIG. 2, the head 20 is provided with a channel forming body 22, a vibration plate 23 and a driving element 24. The channel forming body 22 is a stacked body of a plurality of plates, and the plurality of plates include a nozzle plate 30 and a first channel plate 31 to a fourteenth channel plate 44. The plates are stack on one another in the up-down direction in this order. Note that in the present embodiment, as depicted in FIG. 2, although the head 20 is arranged such that the first channel plate 31 is on the upper side in the up-down direction with respect to the nozzle plate 30, the arrangement of the head 20 is not limited to this.

Each of the plates has holes and grooves of various sizes which are formed therein by the etching, etc. The holes and grooves are combined inside the channel forming body 22 in which the plates are stack, thereby forming a liquid channel. The liquid channel includes, for example, a plurality of individual channels 50 provided with the plurality of nozzles 21, a supply manifold (first manifold) 25 and a return manifold (second manifold) 26.

The plurality of nozzles 21 is formed so as to penetrate through the nozzle plate 30 in the up-down direction. In a lower surface of the nozzle plate 30, openings of the plurality of nozzles 21 are arranged side by side (aligned) in the left-right direction so as to form a nozzle row (nozzle array).

The supply manifold 25 and the return manifold 26 extend to be long in the left-right direction and are connected to the plurality of individual channels 50. The supply manifold 25 is stack on the return manifold 26. A cross-sectional area of a cross section orthogonal to the left-right direction of the supply manifold 25 and a cross-sectional area of a cross section orthogonal to the left-right direction of the return manifold 26 are equal to each other.

The supply manifold 25 is formed of through holes penetrating the eighth channel plate 38 to the eleventh channel plate 41 in the up-down direction and a concavity (recess) recessed from a lower surface of the twelfth channel plate 42 which are overlapped with one another in the up-down direction. Accordingly, a lower end of the supply manifold 25 is covered with the seventh channel plate 37 and an upper end of the supply manifold 25 is covered with an upper side part in the twelfth channel plate 42.

The return manifold 26 is formed of through holes penetrating the second channel plate 32 to the fifth channel plate 35 in the up-down direction and a concavity (recess) recessed from a lower surface of the sixth channel plate 36 which are overlapped with one another in the up-down direction. Accordingly, a lower end of the return manifold 26 is covered with the first channel plate 31 and an upper end of the return manifold 26 is covered with an upper side part in the sixth channel plate 36.

The supply manifold 25 having such a configuration has a supply port and the return manifold 26 having such a configuration has a return port. The supply port is provided on one end in the left-right direction of the supply manifold 25 and is connected to the sub tank by a supply channel. The return port is provided on one end in the left-right direction of the return manifold 26 and is connected to the sub tank by a return channel. The sub tank is arranged in the head 20 and is connected to the storing tank 14 by a piping, and the liquid is supplied from the storing tank 14 to the sub tank. The other end in the left-right direction of the supply manifold 25 and the other end in the left-right direction of the return manifold 26 may be communicated with each other by a bypass channel (the supply port, the return port, the supply channel, the sub tank, the return channel and the bypass channel are not depicted in the drawings).

Each of the plurality of individual channels 50 has an upstream end connected to the supply manifold 25 and a downstream end connected to the return manifold 26, and each of the plurality of individual channels 50 is connected to one of the plurality of nozzles 21 between the upper end and the lower end. Each of the plurality of individual channels 50 has a first communication hole 51, a supply channel 52, a second communication hole 53, a pressure chamber 54, a descender 55, a return channel 56 and a communicating channel 57 which are connected in this order. The plurality of individual channels 50 are arranged at a spacing distance from one another in the left-right direction.

The first communication hole 51 penetrates, in the up-down direction, through an upper side part in the twelfth channel plate 42, is connected to an upper end of the supply manifold 25 at a lower end of the first communication hole 51, and extends upwardly from the supply manifold 25. A cross-sectional area of a cross section, of the first communication hole 51, which is orthogonal to the up-down direction is smaller than a cross-sectional area of a cross section, of the supply manifold 25, orthogonal to the left-right direction.

The supply channel 52 is formed by a groove recessed from a lower surface of the thirteenth channel plate 43. The supply channel 52 has a lower end on one side (front side) in the front-rear direction connected to an upper end of the first communication hole 51 and extends in the front-rear direction. A cross-sectional area of a cross section, of the supply channel 52, which is orthogonal to the front-rear direction is smaller than a cross-sectional area of a cross section, of the first communication hole 51, which is orthogonal to the up-down direction.

The second communication hole 53 penetrates, in the up-down direction, through an upper side part in the thirteenth channel plate 43, and is arranged closer to the other side (rear side) in the front-rear direction, than the first communication hole 51. A lower end of the second communication hole 53 is connected to an upper end on a rear side of the supply channel 52, and the second communication hole 53 extends in the up-down direction. A cross-sectional area of a cross section, of the second communication hole 53, which is orthogonal to the up-down direction is not less than a cross-sectional area of a cross section, of the supply channel 52, which is orthogonal to the front-rear direction.

The pressure chamber 54 is formed to penetrate, in the up-down direction, through the fourteenth channel plate 44; a lower end of the pressure chamber 54 is covered with the thirteenth channel plate 43 and an upper end of the pressure chamber 54 is covered with the vibration plate 23. The pressure chamber 54 has a lower end on a front side thereof which is connected to an upper end of the second communication hole 53, and the pressure chamber 54 extends in the front-rear direction. A cross-sectional area of a cross section, of the pressure chamber 54, which is orthogonal to the front-rear direction is greater than a cross-sectional area of a cross section, of the second communication hole 53, which is orthogonal to the up-down direction.

The descender 55 penetrates, in the up-down direction, through the first channel plate 31 to the thirteenth channel plate 43 and is located on the rear side of (with respect to) the supply manifold 25 and the return manifold 26 in the front-rear direction. The descender 55 has an upper end which is connected to a lower end of the pressure chamber 54, and the descender 55 extends downwardly from the pressure chamber 54; the descender 55 has a lower end which is connected to a base end of each of the plurality of nozzles 21.

The return channel 56 is formed by a groove recessed from the lower surface of the first channel plate 31; a rear end of the return channel 56 is connected to a front end on the lower side of the descender 55 and the return channel 56 extends forward from the descender 55. A cross-sectional area of a cross section, of the return channel 56, which is orthogonal to the extending direction of the return channel 56 is smaller than a cross-sectional area of a cross section, of the descender 55, which is orthogonal to the up-down direction. Note that the details of the return channel 56 will be described later on.

The communicating channel 57 penetrates through the first channel plate 31 in the up-down direction. The communicating channel 57 has: a lower end which is covered with the nozzle plate 30, a rear end of a lower side part thereof which is connected to the front end of the return channel 56, and an upper end which is connected to the lower end of the return manifold 26. A cross-sectional area of a cross section, of the communicating channel 57, which is orthogonal to the up-down direction is greater than a cross-sectional area of a cross section, of the return channel 56, which is orthogonal to the extending direction of the return channel 56. The detail of the communicating channel 57 will be described later on.

The vibration plate 23 is stack on the fourteenth channel plate 44 and covers an opening on an upper end of the pressure chamber 54. Note that the vibration plate 23 may be formed integrally with the fourteenth channel plate 44. In such a case, the pressure chamber 54 is formed by being recessed from the lower surface of the fourteenth channel plate 44. In such a fourteenth channel plate 44, an upper side part which is located above the pressure chamber 54 functions as the vibration plate 23.

The driving element 24 is an element configured to apply a pressure for ejecting the liquid from each of the nozzles 21, and is exemplified by an element of the piezoelectric system, an element of the heating system, an element of the electrostatic attraction system, etc. For example, the driving element 24 is a piezoelectric element, and includes a common electrode 24*a*, a piezoelectric layer 24*b* and an individual electrode 24*c* which are arranged in this order. The common electrode 24*a* covers an entire surface of the vibration plate 23 via an insulation film. The piezoelectric layer 24*b* is provided for each of the pressure chambers 54 and arranged on the common electrode 24*a* so as to overlap with each of the pressure chambers 54. The individual electrode 24*c* is provided for each of the pressure chambers 54 and arranged on the piezoelectric layer 24*b*. In this situation, one piece of the driving element 24 is constructed of one piece of the individual electrode 24*c*, the common electrode 24*a* and a part (active part) of the piezoelectric layer 24*b* which is sandwiched between one piece of the individual electrode 24*c* and the common electrode 24*a*.

The individual electrode 24*c* is electrically connected to a driver IC. This driver IC receives a control signal from the controller 15 (FIG. 1), generates a driving signal (voltage signal) and applies the driving signal to the individual electrode 24*c*. On the other hand, the common electrode 24*a* is constantly maintained at the ground potential.

According to the driving signal, the active part of the piezoelectric layer 24*b* expands and contracts in a plane direction thereof, together with the common electrode 24*a* and the individual electrode 24*c*. With this, the vibration plate 23 cooperates to the expansion/contraction of the active part, and is deformed so as to be displaced in directions for increasing and decreasing the volume of the pressure chamber 54. With this, an ejection pressure for ejecting the liquid from the nozzle 21 is applied to the pressure chamber 54.

<Flow of Liquid>

In the head 20, for example, a pressure pump arranged in the supply channel and a negative pressure pump arranged in the return channel are driven. This causes the liquid to flow from the sub tank and through the supply channel, flows into the supply manifold 25 via the supply port, and flows through the supply manifold 25 in the left-right direction (the pressure pump and the negative pressure pump are not depicted in the drawings).

During this time, a part of the liquid flows into each of the plurality of individual channels 50. In each of the plurality of individual channels 50, the liquid flows from the supply manifold 25 into the supply channel 52 via the first communication hole 51, flows in the supply channel 52 rearwards, flows from the supply channel 52 into the pressure chamber 54 through the second communication hole 53, and flows in the pressure chamber 54 rearwards. Then, the liquid flows from the pressure chamber 54 into the descender 55, flows in the descender 55 downwards, and flows into the nozzle 21. Here, in a case that the ejection pressure is applied to the pressure chamber 54 by the driving element 24, the liquid is ejected or discharged from the nozzle 21. The liquid (another part of the liquid) which has not been ejected from the nozzle 21 flows in the return channel 56 frontwards and flows into the return manifold 26 via the communicating channel 57. The liquid flows in the return manifold 26 to the return port.

Further, the liquid (yet another part of the liquid) which has not flowed into the individual channel 50 flows in the supply manifold 25 from the supply port in the left-right direction and flows into the return manifold 26 via the bypass channel. The liquid (yet another part of the liquid) flowing in the bypass channel merges with the another part of liquid which has flowed through the individual channel 50 and flowed into the return manifold 26, without being ejected (from the nozzle 50), while the yet another part of the liquid flows in the return manifold 26 from the bypass channel to the return port. The merged liquid is then discharged from the return port and returns to the sub tank via the return channel. As a result, the liquid (another part of the liquid or the yet another part of the liquid) which has not been ejected from the opening of the nozzle 21 circulates between the sub tank and the individual channel 50 or between the sub tank and the bypass channel.

<Return Channel and Communicating Channel>

Figure 3A:
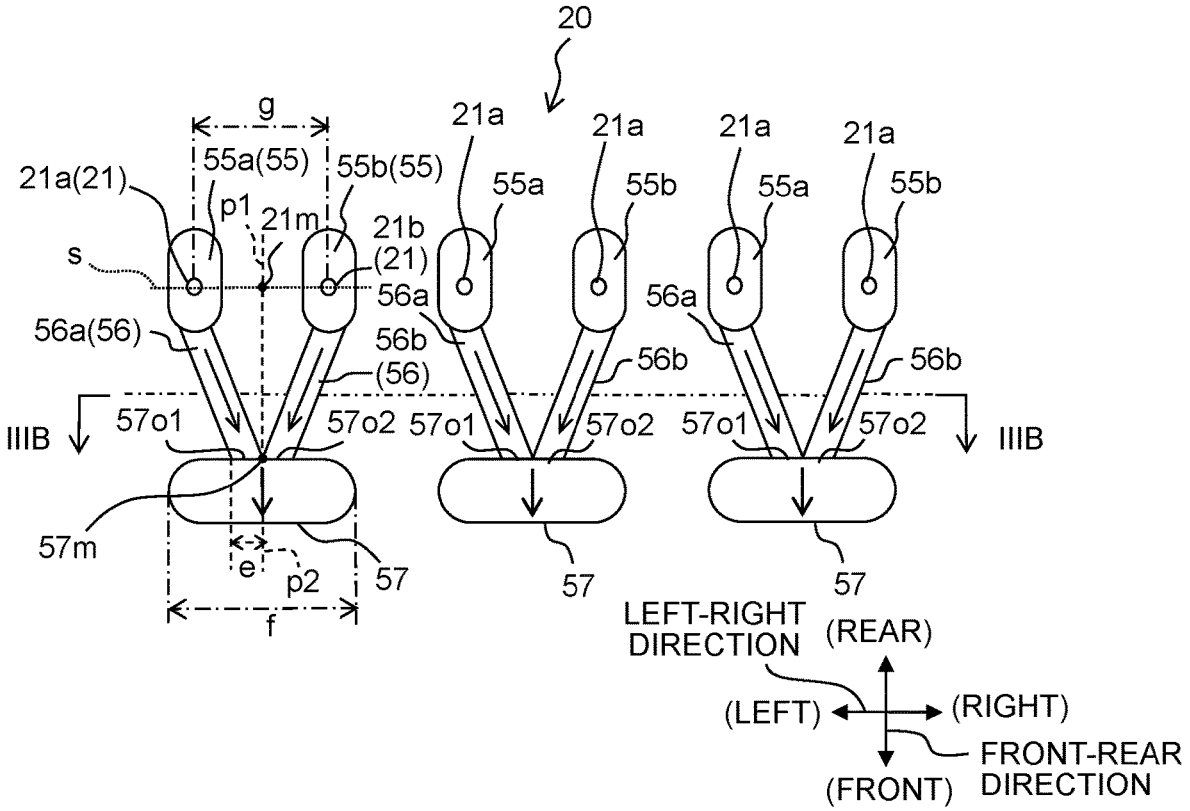
FIG. 3A is a view of a descender, a return channel and a communicating channel of FIG. 1, as seen from the upper side.
Figure 3B:
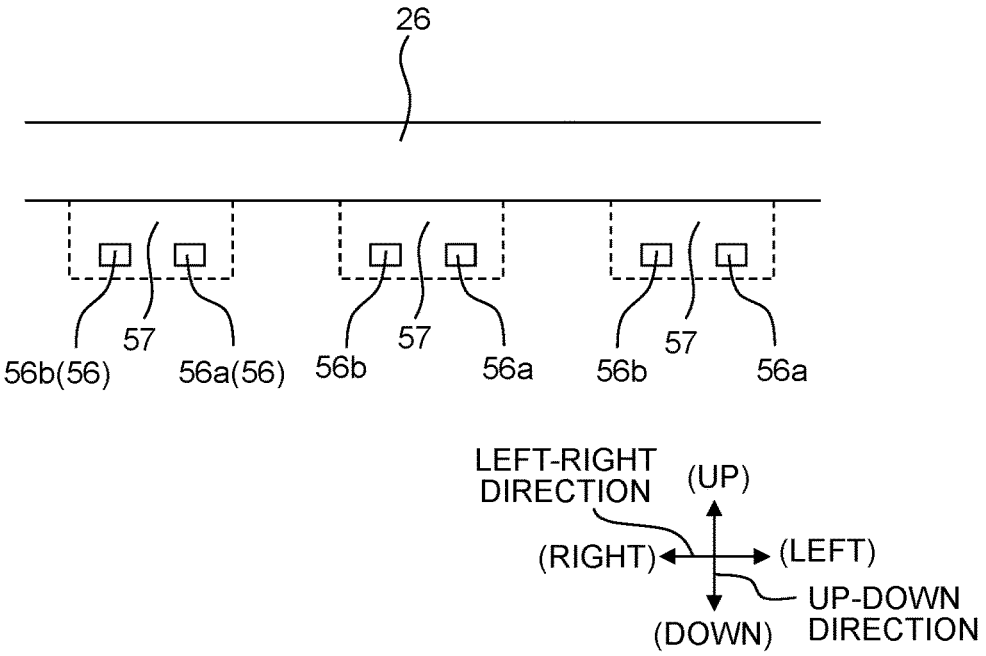
FIG. 3B is a cross-sectional view cut along the IIIB-IIIB line of FIG. 3A.

As depicted in FIG. 3A and FIG. 3B, in the head 20, one end of each of a plurality of pieces of the return channel 56 are connected to one of the plurality of descenders 55, and extends from one of the plurality of descenders 55 in a direction crossing the extending direction (the up-down direction) of the plurality of descenders 55. The communicating channel (first communicating channel) 57 is connected to the return manifold 26 and to the other ends of a first return channel 56*a* and a second return channel 56*b*, respectively, which are included in the plurality of return channels 56 and which are adjacent to each other.

Specifically, the plurality of descenders 55 are arranged at a spacing distance from each other in the left-right direction. The plurality of descenders 55 have a first descender 55*a* and a second descender 55*b* which are adjacent to each other in the left-right direction. A plurality of the communicating channels 57 are arranged at a spacing distance from each other in the left-right direction. Each of the plurality of communicating channels 57 is arranged between the first descender 55*a* and the second descender 55*b* in the left-right direction. The plurality of return channels 56 have a first return channel 56*a* and a second return channel 56*b* which are arranged at a spacing distance from each other in the left-right direction between a row of the plurality of descenders 55 and a row of the plurality of communicating channels 57 in the front-rear direction, and which are adjacent to each other in the left-right direction.

Each of the plurality of return channels 56 extends in a direction crossing (e.g., in a direction orthogonal to) the up-down direction and is arranged while being inclined (at an angle) with respect to the left-right direction and the front-rear direction. The rear end of each of the plurality of return channels 56 is connected to one of the plurality of descenders 55, and the front end of each of the plurality of return channels 56 is connected to one of the plurality of communicating channels 57. Here, although the first return channel 56*a* and the second return channel 56*b* which are adjacent to each other are connected to the first descender 55*a* and the second descender 55*b* which are different from each other, the first return channel 56*a* and the second return channel 56*b* are connected to a same communicating channel (first communicating channel) 57 among the plurality of communicating channels 57. Thus, while one piece among the plurality of return channels 56 is connected to one piece of the plurality of descenders 55, a plurality of pieces (for example, 2 pieces) of the return channels 56 are connected to one piece among the plurality of communicating channels 57.

The first return channel 56*a* is connected to the first descender 55*a* and the second return channel 56*b* is connected to the second descender 55*b*. The first descender 55*a* has a connection port connected to the first return channel 56*a*, and this connection port is provided at the center in the left-right direction, at a front end of the first descender 55*a*. The second descender 55*b* has a connection port connected to the second return channel 56*b*, and this connection port is provided at the center of the left-right direction, at a front end of the second descender 55*b*.

Each of the plurality of communicating channels (first communicating channels) 57 has a first connection port 57*o*1 connected to the first return channel 56*a* and a second connection port 57*o*2 connected to the second return channel 56*b*. The first connection port 57*o*1 and the second connection port 57*o*2 are provided on a rear end in each of the plurality of communicating channels 57 and are arranged side by side in left-right direction.

According to such a configuration, the liquid from the first descender 55*a* flows in the first return channel 56*a* from the rear end to the front end (from one end to the other end) thereof, and flows into the communicating channel 57 from the first connection port 57*o*1. Further, the liquid from the second descender 55*b* flows in the second return channel 56*b* from the rear end to the front end (from one end to the other end) thereof, and flows into the communicating channel 57 from the second connection port 57*o*2. The liquids inflowed from the first return channel 56*a* and the second return channel 56*b* join at the communicating channel 57 and flow out to the return manifold 26. Therefore, since a flow amount of the liquid which is greater than a flow amount of the liquid in each of the first return channel 56*a* and the second return channel 56*b* flows into the communicating channel 57, any remaining (stagnation) of an air bubble in the communicating channel 57 is reduced, thereby making it possible to suppress any ejection failure (unsatisfactory ejection) due to the air bubble.

Furthermore, in the head 20, the first return channel 56*a* extends linearly from the one end to the other end in a first extending direction crossing (for example, orthogonal to) the up-down direction, and the second return channel 56*b* extends linearly from the one end to the other end in a second extending direction crossing (for example, orthogonal to) the up-down direction. According to such a configuration, the liquid from the first descender 55*a* flows in the first extending direction which is constant in the first return channel 56*a* and the liquid from the second descender 55*b* flows in the second extending direction which is constant in the second return channel 56*b*. Therefore, the air bubble is less likely to stay in each of the plurality of return channels 56, and the ejection failure (unsatisfactory ejection) due to the air bubble can be suppressed.

Moreover, in the head 20, a cross-sectional area of a cross section (third cross-sectional area), of the communicating channel 57, which is orthogonal to the left-right direction is greater than either one of the cross section (first cross-sectional area) of a cross section, of the first return channel 56*a*, which is orthogonal to the first extending direction and a cross-sectional area (second cross-sectional area) of the cross section, of the second return channel 56*b*, which is orthogonal to the second extending direction.

Specifically, the first extending direction is a direction extending from the rear side to the front side in the front-rear direction and extending from the left side to the right side of the left-right direction. The second extending direction is a direction extending from the rear side to the front side in the front-rear direction and extending from the right side to the left side of the left-right direction. Thus, in the left-right direction, the first extending direction and the second extending direction are directions opposite to each other. Further, the first extending direction and the second extending direction are inclined in mutually opposite directions (orientations) with respect to the front-rear direction. An angle of the first extending direction relative to the front-rear direction is equal to an angle of the second extending direction relative to the front-rear direction. In this case, a direction of resultant of the first extending direction and the second extending direction is the front-rear direction.

The third cross-sectional area of the communicating channel 57 is greater than the first cross-sectional area of the first return channel 56*a* and greater than the second cross-sectional area of the second return channel 56*b*. The first cross-sectional area of the first return channel 56*a* is constant in the first extending direction. The second cross-sectional area of the second return channel 56*b* is constant in the second extending direction. The third cross-sectional area of the communicating channel 57 is substantially constant in the left-right direction. However, the cross-sectional area of the first return channel 56*a* may change in the first extending direction, the cross-sectional area of the second return channel 56*b* may change in the second extending direction, and the third cross-sectional area of the communicating channel 57 may change in the left-right direction. In such a case, the minimum cross-sectional area in the third cross-sectional area of the communicating channel 57 is greater than the maximum cross-sectional area in the first cross-sectional area of the first return channel 56*a* and the maximum cross-sectional area in the second cross-sectional area of the second return channel 56*b*.

According to such a configuration, for example, the pressure applied, by the driving element 24, to the nozzle 21 from the pressure chamber 54 via the first descender 55*a* is released in the communicating channel 57 even if the pressure propagates in the first return channel 56*a*. Thus, it is possible to reduce any transmission of the pressure to the second return channel 56*b* via the communicating channel 57. In addition, the pressure applied, by the driving element 24, to the nozzle 21 from the pressure chamber 54 via the second descender 55*b* is released in the communicating channel 57 even if the pressure propagates in the second return channel 56*b*. Thus, it is possible to reduce any transmission of the pressure to the first return channel 56*a* via the communicating channel 57. In this manner, it is possible to suppress any occurrence of crosstalk via each of the return channels 56.

Further, in the head 20, the first extending direction and the second extending direction are different from each other, and the first return channel 56*a* and the second return channel 56*b* are arranged so that the spacing distance between the first return channel 56*a* and the second return channel 56*b* becomes smaller from the descender 55 toward the communicating channel 57. Here, the spacing distance between the first return channel 56*a* and the second return channel 56*b* is, for example, a distance between an end of the first return channel 56*a* and an end of the second return channel 56*b* which face each other in the left-right direction.

Specifically, a spacing distance between the rear end of the first return channel 56*a* connected to the first descender 55*a* and the rear end of the second return channel 56*b* connected to the second descender 55*b* is wider than a spacing distance between the front end of the first return channel 56*a* connected to the communicating channel 57 and the front end of the second return channel 56*b* connected to the communicating channel 57. The spacing distance between the first return channel 56*a* and the second return channel 56*b* in the left-right direction gradually decreases or becomes smaller from the rear side to the front side. In a case that the first return channel 56*a*, the communicating channel 57 and the second return channel 56*b* are seen from the upper side of the up-down direction, the first return channel 56*a*, the communicating channel 57 and the second return channel 56*b* are arranged in a V-shape. The respective return channels 56 are inclined with respect to the front-rear direction. According to this configuration, it is possible to miniaturize the head 20 in the front-rear direction without changing the length of the respective return channels 56.

Furthermore, in the head 20, a spacing distance between the first connection port 57*o*1 connecting the first return channel 56*a* and the communicating channel 57 and the second connection port 57*o*2 connecting the second return channel 56*b* and the communicating channel 57 is less than a maximum width e in the left-right direction of the first connection port 57*o*1. Here, the spacing distance between the first connection port 57*o*1 and the second connection port 57*o*2 is a spacing distance in the left-right direction and is, for example, a distance between an end of the first connection port 57*o*1 and an end of the second connection port 57*o*2 which face each other in the left-right direction. Note that in a case that the first connection port 57*o*1 is circular, the maximum width e in the left-right direction is the diameter of the first connection port 57*o*1.

Specifically, the first return channel 56*a* and the second return channel 56*b* are independent of each other without being connected to each other, and the front ends of the first return channel 56*a* and the second return channel 56*b* are connected to the communicating channel 57. In the communicating channel 57, the first connection port 57*o*1 and the second connection port 57*o*2 are adjacent to each other in the left-right direction without overlapping with each other. The spacing distance between the first connection port 57*o*1 and the second connection port 57*o*2 is, for example, less than the maximum width e in the left-right direction of the first connection port 57*o*1. According to this configuration, by narrowing the spacing distance between the first return channel 56*a* and the second return channel 56*b*, it is possible to miniaturize the head 20 in the left-right direction. Note that in the present embodiment, the maximum width in the left-right direction of the second connection port 57*o*2 is same as the maximum width in the left-right direction of the first connection port 57*o*1. Accordingly, the spacing distance in the left-right direction between the first connection port 57*o*1 and the second connection port 57*o*2 is less than the maximum width of the second connection port 57*o*2. Further, in the present embodiment, the first connection port 57*o*1 and the second connection port 57*o*2 make contact with each other, without overlapping with each other. Namely, the spacing distance between the first connection port 57*o*1 and the second connection port 57*o*2 are 0 (zero).

The head 20 also includes a first nozzle 21*a* connected to the first descender 55*a* and a second nozzle 21*b* connected to the second descender 55*b*. As depicted in FIG. 3, a straight line passing the first nozzle 21*a* and the second nozzle 21*b* is defined as a straight line s, and a middle point of the first nozzle 21*a* and the second nozzle 21*b* is defined as a nozzle middle point 21*m*. A plane passing the nozzle middle point 21*m* and orthogonal to the straight line s is defined as a first plane p1. A middle point between the first connection port 57*o*1 connecting the first return channel 56*a* and the communicating channel 57 and the second connection port 57*o*2 connecting the second return channel 56*b* and the communicating channel 57 is defined as a connection port middle point 57*m*. The connection port middle point 57*m* is arranged on the first plane p1. Note that the connection port middle point 57*m* is, for example, a middle point between an end of the first connection port 57*o*1 and an end of the second connection port 57*o*2 which face each other in the left-right direction.

Specifically, the plurality of nozzles 21 have the first nozzle 21*a* and the second nozzle 21*b* which are adjacent to each other in the left-right direction. The first nozzle 21*a* is arranged in the center in the left-right direction of the first descender 55*a*, and the second nozzle 21*b* is arranged in the center in the left-right direction of the second descender 55*b*. The first nozzle 21*a* and the second nozzle 21*b* are arranged at the spacing distance from each other in the left-right direction. The straight line s passing the first nozzle 21*a* and the second nozzle 21*b* passes the center of the base end of the first nozzle 21*a* connected to the first descender 55*a* and the center of the base end of the second nozzle 21*b* connected to the second descender 55*b*, and extends in the left-right direction. Further, in the communicating channel 57, the first connection port 57*o*1 and the second connection port 57*o*2 are arranged to be adjacent to each other in the left-right direction. Note that in the present embodiment, the first connection port 57*o*1 and the second connection port 57*o*2 make contact with each other, without overlapping with each other. Namely, the first connection port 57*o*1 and the second connection port 57*o*2 make contact with each other in the connection port middle point 57*m*.

As described above, the connection port middle point 57*m* is arranged on the first plane p1. Accordingly, the first connection port 57*o*1 and the second connection port 57*o*2 are arranged to be plane-symmetrical to each other, and the first nozzle 21*a* and the second nozzle 21*b* are arranged to be plane-symmetrical to each other.

As a result, a flow of the liquid flowing from the first descender 55*a* to the communicating channel 57 via the first return channel 56*a* and a flow of the liquid flowing from the second descender 55*b* to the communicating channel 57 via the second return channel 56*b* become equal to each other. Therefore, it is possible to reduce any deviation, from the predetermined direction, of a direction of the liquid ejected from the first descender 55*a* via the first nozzle 21*a* and a direction of the liquid ejected from the second descender 55*b* via the second nozzle 21*b*.

Further, in the head 20, the first return channel 56*a* and the second return channel 56*b* are formed symmetrically with respect to a plane (second plane p2) which is orthogonal to the straight line s passing the middle point (nozzle middle point 21*m*) of the first nozzle 21*a* and the second nozzle 21*b* and passing the first nozzle 21*a* and the second nozzle 21*b*. Note that in the present embodiment, the first plane p1 and the second plane P2 are a same plane.

Specifically, the second plane p2 passes the nozzle middle point 21*m* and is orthogonal to the left-right direction. The first return channel 56*a* and the second return channel 56*b* are formed symmetrically to each other, with respect to the second plane p2. Thus, the first cross-sectional area of the first return channel 56*a* and the second cross-sectional area of the second return channel 56*b* are equal to each other. The length of the first return channel 56*a* extending in the first extending direction and the length of the second return channel 56*b* extending in the second extending direction are equal to each other. An inclination angle of the first return channel 56*a* with respect to the front-rear direction and an inclination angle of the second return channel 56*b* with respect to the front-rear direction are equal to each other. According to this configuration, the liquid flows uniformly from the first descender 55*a* to the first return channel 56*a* and from the second descender 55*b* to the second return channel 56*b*. Thus, it is possible to reduce any deviation, from the predetermined direction, of the directions of the liquids ejected from the descenders 55 via the nozzles 21, respectively.

Further, in the head 20, a size (maximum width) f of the communicating channel 57 is greater than a spacing distance g between the first nozzle 21*a* and the second nozzle 21*b* in a direction (left-right direction) in which the first nozzle 21*a* and the second nozzle 21*b* are aligned or arranged side by side to each other. According to this configuration, it is possible to make the spacing distance between the first return channel 56*a* and the second return channel 56*b* which are connected to the same communicating channel 57 and arranged side by side in the left-right direction to be great, and to suppress the crosstalk.

<First Modification>

Figure 4A:
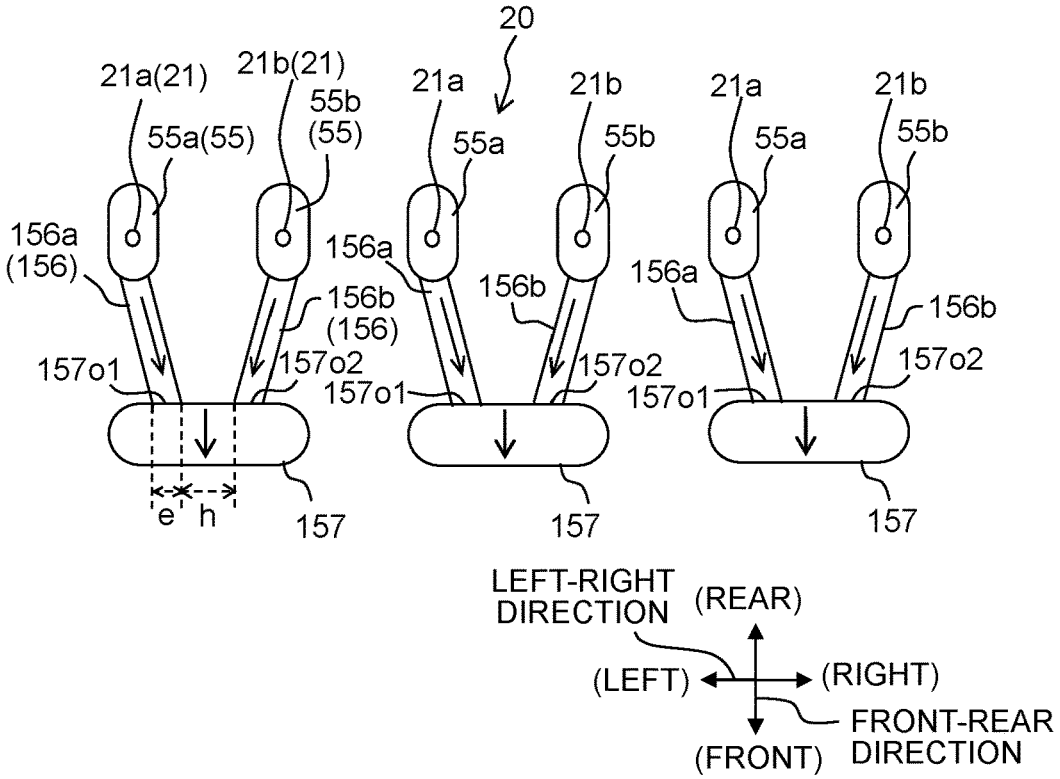
FIG. 4A is view of a descender, a return channel and a communicating channel in a liquid ejecting head of a first modification of the first embodiment of the present disclosure, as seen from the upper side.

As depicted in FIG. 4A, in a head 20 according to a first modification, a spacing distance h in the left-right direction between a first connection port 157*o*1 connecting a first return channel 156*a* and a communicating channel 157 and a second connection port 157*o*2 connecting a second return channel 156*b* and the communicating channel 157 is not less than a maximum width e in the left-right direction of the first connection port 157*o*1. Since the head 20 of the first modification is similar to that of the head 20 of the first embodiment except for this spacing distance, any further description of the head 20 of the first modification is omitted.

Specifically, the first connection port 157*o*1 and the second connection port 157*o*2 are arranged at the spacing distance h in the left-right direction. This spacing distance h is not less than the maximum width e in the left-right direction of the first connection port 157*o*1. In this manner, by increasing the spacing distance between the first return channel 156*a* and the second return channel 156*b*, it is possible to suppress the crosstalk.

<Second Modification>

Figure 4B:
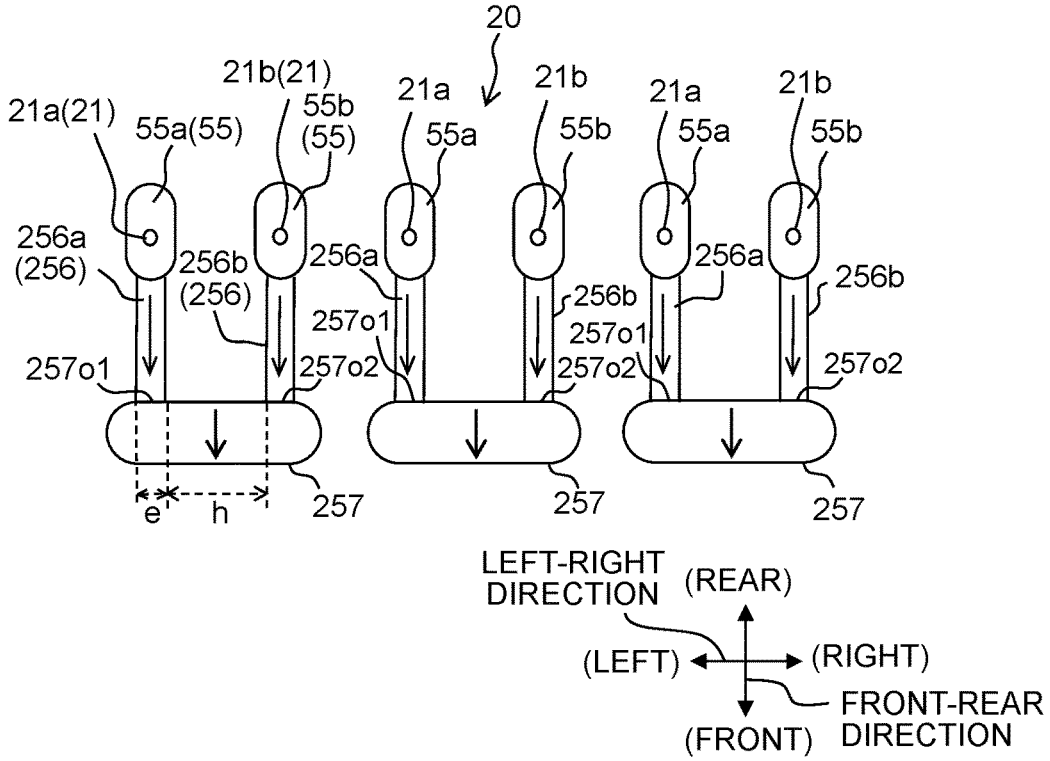
FIG. 4B is view of a descender, a return channel and a communicating channel in a liquid ejecting head of a second modification of the first embodiment of the present disclosure, as seen from the upper side.

As depicted in FIG. 4B, in a head 20 according to a second modification, the first extending direction and the second extending direction are same. A first return channel 256*a* and a second return channel 256*b* are arranged parallel to each other. A spacing distance h between a first connection port 257*o*1 connecting the first return channel 256*a* and a communicating channel 257 and a second connection port 257*o*2 connecting the second return channel 256*b* and the communicating channel 257 is not less than the maximum width in the left-right direction of the first connection port 257*o*1. Since the head 20 of the second modification is similar to that of the first embodiment, except for this point, any further description of the head 20 of the second modification is omitted.

For example, the first extending direction and the second extending direction are the front-rear direction, and the return ports 256 extend in the front-rear direction from the descenders 55, respectively, to the communicating channel 257. The spacing distance between the first return channel 256*a* and the second return channel 256*b* in the left-right direction is constant from the descender 55 to the communicating channel 257. Thus, by separating the first connection port 257*o*1 and the second connection port 257*o*2 away from each other in the communicating channel 257, it is possible to secure or obtain a large spacing distance between the first return channel 256*a* and the second return channel 256*b*, and to suppress the crosstalk.

<Third Modification>

Figure 5A:
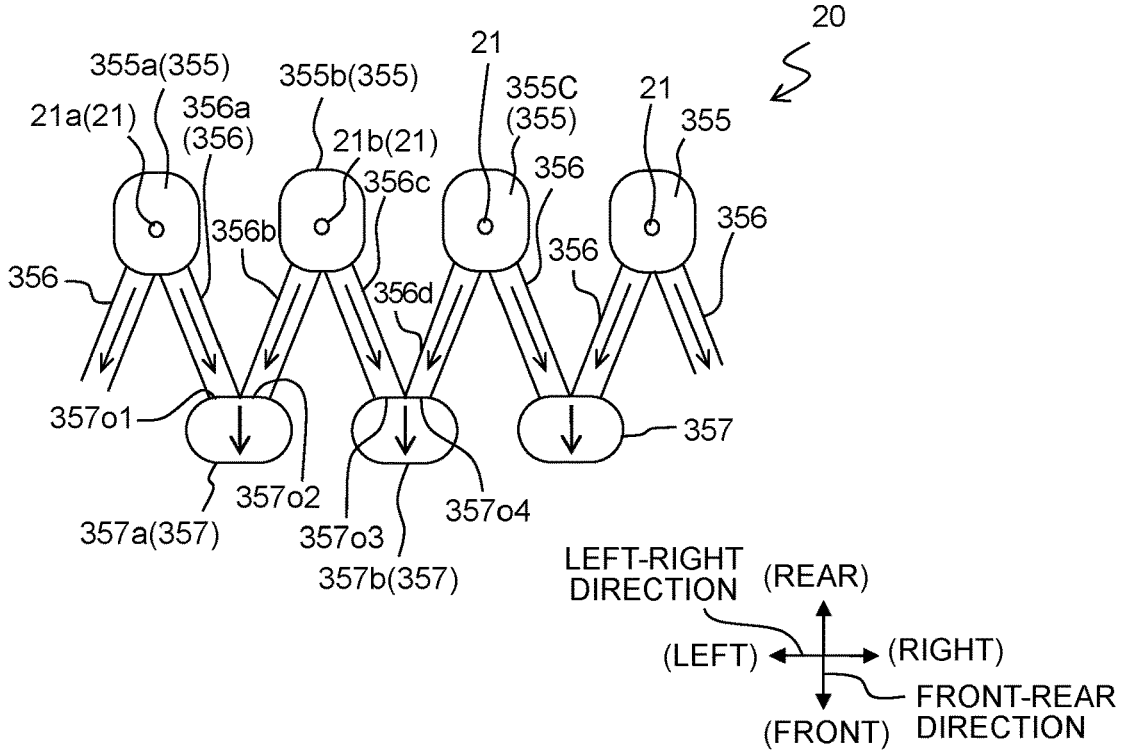
FIG. 5A is view of a descender, a return channel and a communicating channel in a liquid ejecting head of a third modification of the first embodiment of the present disclosure, as seen from the upper side.

As depicted in FIG. 5A, in a head 20 according to a third modification, the return manifold 26 (FIG. 2) is connected to a plurality of communicating channels 357. The plurality of communicating channels 357 have a first communicating channel 357*a* and a second communicating channel 357*b* which are adjacent to each other. Similarly to the first embodiment, two return channels 356 which are adjacent to each other are connected each of to the first communicating channel 357*a* and the second communicating channel 357*b*, respectively. Here, the two return channels 356 connected to the first communicating channel 357*a* are referred to as a first return channel 356*a* and a second return channel 356*b*; and the two return channels 356 connected to the second communicating channel 357*b* are referred to as a third return channel 356*c* and a fourth return channel 356*d*. The second return channel 356*b* connected to the first communicating channel 357*a* and the third return channel 356*c* connected to the second communicating channel 357*b* are adjacent to each other and are connected to a same descender 355 (second descender 355*b*). Namely, in the first embodiment, only one piece of the return channel 56 is connected to each of the plurality of descenders 55. In contract, in the third modification, two return channels 356 which are adjacent to each other are connected to each of the plurality of descenders 355. Since the head 20 of the third modification is similar to that of the first embodiment, except for this point, any further description of the head 20 of the third modification is omitted.

Specifically, the descender 355 is connected to rear ends of two return channels 356 and has connection ports with the rear ends of the two return channels 356, respectively. The two return channels 356 connected to the same descender 355 extend to opposite sides to each other in the left-right direction toward different communicating channels 357, respectively. The two return channels 356 connected to the same descender 355 are inclined relative to the front-rear direction such that a spacing distance therebetween in the left-right direction is expanding or becoming wider.

The descender 355 includes a first descender 355*a*, a second descender 355*b* and a third descender 355*c* which are arranged side by side in this order in the left-right direction. The first return channel 356*a* connected to the first communicating channel 357*a* is connected to the first descender 355*a*. The second return channel 356*b* connected to the first communicating channel 357*a* and the third return channel 356*c* connected to the second communicating channel 357*b* are connected to the second descender 355*b*. The fourth return channel 356*d* connected to the second communicating channel 357*b* is connected to the third descender 355*c*. The first return channel 356*a* connected to the first descender 355*a*, and the second return channel 356*b* connected to the second descender 355*b* extend toward the first communicating channel 357*a* so that the spacing distance in the left-right direction between the first return channel 356*a* and the second return channel 356*b* approaches each other, and are connected to the first communicating channel 357*a*. The third return channel 356*c* connected to the second descender 355*b*, and the fourth return channel 356*d* connected to the third descender 355*c* extend toward the second communicating channel 357*b* so that the spacing distance in the left-right direction between the third return channel 356*c* and the fourth return channel 356*d* approaches each other, and are connected to the second communicating channel 357*b*. Accordingly, as seen from the upper side of the up-down direction, the first return channel 356*a*, the second return channel 356*b*, the third return channel 356*c* and the fourth return channel 356*d* are arranged in a W-shape.

The first communicating channel 357*a* has a first connection port 357*o*1 connected to a front end of the first return channel 356*a*, and a second connection port 357*o*2 connected to a front end of the second return channel 356*b*. The second communicating channel 357*b* has a third connection port 357*c*3 connected to a front end of the third return channel 356*c*, and a fourth connection port 357*o*4 connected to a front end of the fourth return channel 356*d*.

With such a configuration, the liquid from each of the plurality of descenders 355 is branched into the two return channels 356 connected to each of the plurality of descenders 355. As a result, since the flow in the descenders 355 becomes uniform, it is possible to reduce any deviation, from a predetermined direction, in a direction of the liquid which is ejected discharged from each of the descenders 355 via one of the nozzles 21.

Also, the liquid from the first return channel 356*a* connected to the first descender 355*a* and the liquid from the second return channel 356*b* connected to the second descender 355*b* merge or are combined at the first communicating channel 357*a*. The liquid from the third return channel 356*c* connected to the second descender 355*b* and the liquid from the fourth return channel 356*d* connected to the third descender 355*c* merge at the second communicating channel 357*b*. This suppresses any lowering in the velocity of the liquid flowing through the communicating channel 357 which would be otherwise caused due to any branching. Accordingly, it is possible to lower any remaining (stagnation) of the air bubble, and to suppress any ejection failure (unsatisfactory ejection) due to the air bubble.

<Fourth Modification>

Figure 5B:
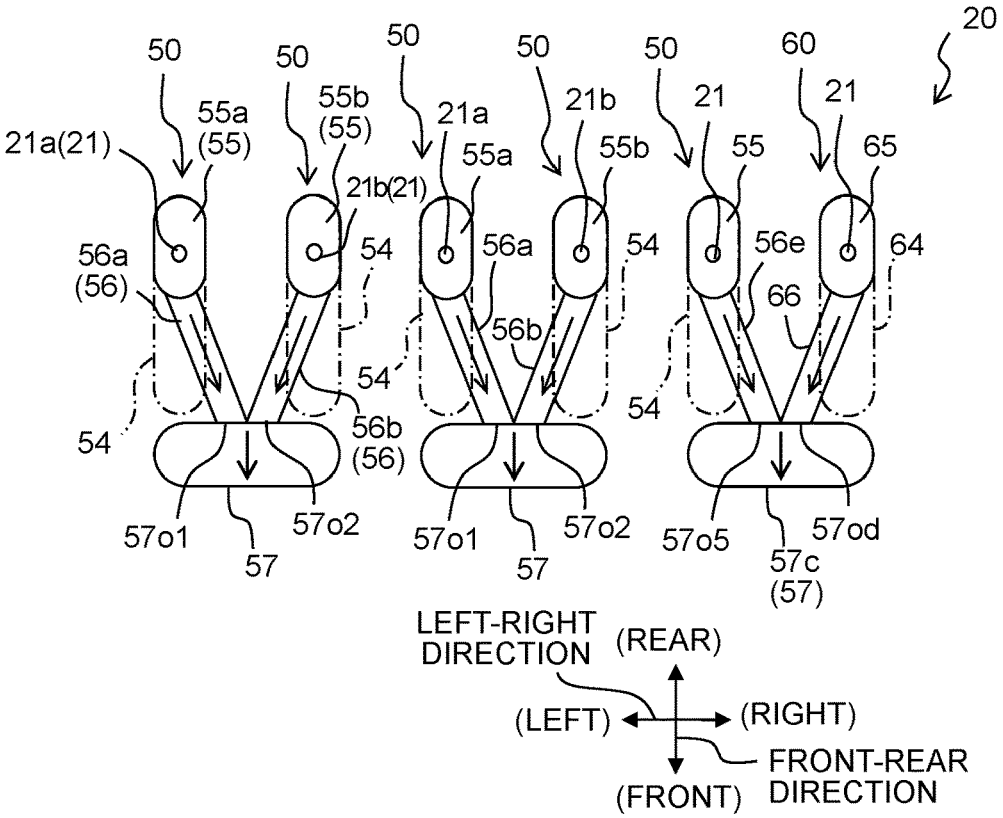
FIG. 5B is a view of a descender, a return channel and a communicating channel in a liquid ejecting head of a fourth modification of the first embodiment of the present disclosure, as seen from the upper side.

As depicted in FIG. 5B, a head 20 according to a fourth modification includes: a dummy chamber 64 arranged adjacently to the pressure chambers 54; a dummy descender 65 extending in the up-down direction from the dummy chamber 64; and a dummy return channel 66 extending from the dummy descender 65 in a direction crossing an extending direction (up-down direction) of the dummy descender 65. The dummy return channel 66 is connected to the communicating channel 57 (third communicating channel 57*c*), together with a return channel 56 (a fifth return channel 56*e*) which is adjacent to the dummy return channel 66.

Specifically, the head 20 has the dummy channel 60 and a plurality of individual channels 50. The dummy channel 60 and the plurality of individual channels 50 are arranged side by side to form a row (array) in the left-right direction, and the dummy channel 60 is arranged on an end of the row.

An upstream end of the dummy channel 60 is connected to the supply manifold 25, and a downstream end of the dummy channel 60 is connected to the return manifold 26. The dummy channel 60 has a first dummy hole, a dummy supply channel, a second dummy hole, the dummy chamber 64, the dummy descender 65, the dummy return channel 66 and the third communicating channel 57*c* which are connected in this order. The third communicating channel 57*c* is used commonly for the dummy channel 60 and the individual channel 50.

The dummy channel 60 is similar to the individual channel 50 except that the dummy channel 60 does not eject the liquid from the nozzle 21. For example, such a configuration is provided so as not to eject the liquid from a nozzle 21 connected to the dummy channel 60 such that the controller 15 (FIG. 1) is not connected to a driving element 24 (corresponding to the dummy channel 60) so that the driving element 24 is not driven. However, the configuration of not ejecting the liquid from the nozzle 21 (corresponding to the dummy channel 60) is not limited to this. For example, it is allowable that the dummy channel 60 is not connected to the nozzle 21, or that any driving element 24 is not provided corresponding to the dummy chamber 64.

The dummy channel 60 has a similar shape to that of the individual channel 50. Therefore, the first dummy hole, the dummy supply channel, the second dummy hole, the dummy chamber 64, the dummy descender 65 and the dummy return channel 66 in the dummy channel 60 have the same shapes as those of the first communication hole 51, the supply channel 52, the second communication hole 53, the pressure chamber 54, the descender 55 and the return channel 56 in the individual channel 50, respectively.

The fifth return channel 56*e* which is located at an end in the row of the plurality of individual channels 50 and the dummy return channel 66 of the dummy channel 60 are arranged next (adjacent) to each other in the left-right direction. The fifth return channel 56*e* and the dummy return channel 66 are connected to the same third communicating channel 57*c*. The third communicating channel 57*c* has a fifth connection port 57*o*5 with respect to the fifth return channel 56*e* and a dummy connection port 57*od* with respect to the dummy return channel 66. A rear end of the dummy return channel 66 is connected to the dummy descender 65, and a front end of the dummy return channel 66 is connected to the third communicating channel 57*c*.

For example, in a case that the number of the return channel 56 aligned in the left-right direction is an odd number, the fifth return channel 56*e* at the end cannot form a pair with another return channel 56. Accordingly, any structural difference occurs between a certain individual channel 50 including the fifth return channel 56*e* at the end and individual channels 50 which are different from the certain individual channel 50. As a result, the ejection of the liquid is fluctuated or varied among the individual channels 50. On the other hand, in the fourth modification, the fifth return channel 56*e* at the end and the dummy return channel 66 adjacent to the fifth return channel 56*e* at the end are connected to the same the third communicating channel 57*c*. This makes it possible to form pairs with all the return channels 56 and the dummy return channel 66 and to connect the pairs to the communicating channels 57, thereby making it possible to make the structures of the plurality of individual channels 50 which are aligned in the left-right direction to be uniform. Therefore, the liquid flows also in the fifth return channel 56*e* at the end which is paired with the dummy return channel 66, similarly to another first return channel(s) 56*a*. Therefore, the nozzle 21 communicating with the fifth return channel 56*e* at the end has an ejecting performance similar to that of the other nozzles 21 communicating respectively with the other return channels 56*a*. As a result, any unevenness or fluctuation in the ejection in the head 20 can be reduced.

The above-described embodiment and modifications may be combined with each other as long as they are not mutually exclusive. For example, the third modification may be applied to the first modification and the second modification, and the fourth modification may be applied to the first modification to the third modification.

Further, from the foregoing explanation, many improvements and other embodiments of the present disclosure will be apparent to those skilled in the art. Accordingly, the foregoing explanations are to be construed as illustrative only and are provided for purposes of teaching those skilled in the art the best aspect for carrying out the present disclosure. The configuration and/or the detailed function of the present disclosure may be substantially changed, without departing from the spirit of the present disclosure.

The liquid ejecting head of the present disclosure is useful as a liquid ejecting head capable of suppressing the ejection failure (unsatisfactory ejection) due to the air bubble, etc.

What is claimed is:

1. A liquid ejecting head comprising a channel forming body including a plurality of individual channels, a first manifold and a second manifold, wherein the plurality of individual channels are connected to the first manifold and the second manifold, wherein the plurality of individual channels includes:

at least one nozzle, at least one pressure chamber which is arranged to be apart from the at least one nozzle in a first direction, and which communicates with the first manifold, at least one descender communicating the at least one pressure chamber and the at least one nozzle with each other, and extending in the first direction, at least one return channel extending in a direction crossing the first direction, and having one end connected to the at least one descender, and at least one communicating channel connecting the other end of the at least one return channel to the second manifold;

the at least one return channel includes a first return channel and a second return channel which are adjacent to each other in a second direction orthogonal to the first direction;

the at least one communicating channel includes a first communicating channel which connects the first return channel to the second manifold and connects the second return channel to the second manifold;

wherein the at least one descender includes a first descender connected to the first return channel and a second descender connected to the second return channel, the first descender and the second descender being adjacent to each other in the second direction;

the at least one nozzle includes a first nozzle connected to the first descender, and a second nozzle connected to the second descender, the first nozzle and the second nozzle being aligned in the second direction; and in the second direction, a maximum width of the first communicating channel is greater than a spacing distance between the first nozzle and the second nozzle.

2. The liquid ejecting head according to claim 1, wherein the first return channel extends linearly from the one end to the other end in a first extending direction crossing the first direction; and the second return channel extends linearly from the one end to the other end in a second extending direction crossing the first direction.

3. The liquid ejecting head according to claim 2, wherein a third cross-sectional area of a cross section, of the first communicating channel, orthogonal to the second direction is greater than either one of a first cross-sectional area of a cross section of the first return channel orthogonal to the first extending direction and a second cross-sectional area of a cross section of the second return channel orthogonal to the second extending direction.

4. The liquid ejecting head according to claim 2, wherein the first extending direction and the second extending direction are different from each other; and a spacing distance between the first return channel and the second return channel in the second direction becomes smaller toward the first communicating channel.

5. The liquid ejecting head according to claim 1, wherein the at least one descender includes:

a first descender connected to the first return channel, and a second descender connected to the second return channel; and the first descender and the second descender are adjacent to each other in the second direction.

6. The liquid ejecting head according to claim 1, wherein the at least one return channel includes a plurality of return channels;

only one return channel among the plurality of return channels is connected to the at least one descender.

7. The liquid ejecting head according to claim 1, wherein the at least one return channel further includes a third return channel and a fourth return channel which are adjacent to each other in the second direction;

the at least one communicating channel further includes a second communicating channel connecting the third return channel to the second manifold and connecting the fourth return channel to the second manifold, the first communicating channel and the second communicating channel being adjacent to each other in the second direction; and the second return channel and the third return channel are adjacent to each other in the second direction, and are connected to a same descender included in the at least one descender.

8. The liquid ejecting head according to claim 7, wherein the at least one descender includes:

a first descender connected to the first return channel, a second descender connected to the second return channel and the third return channel, and a third descender connected to the fourth return channel; and the first descender, the second descender and the third descender are arranged side by side in this order in the second direction.

9. The liquid ejecting head according to claim 1, wherein the at least one return channel includes a plurality of return channels; and two return channels, adjacent to each other in the second direction, among the plurality of return channels are connected to the at least one descender.

10. The liquid ejecting head according to claim 2, wherein the first extending direction is parallel to the second extending direction.

11. The liquid ejecting head according to claim 10, wherein the first extending direction and the second extending direction are a third direction orthogonal to the first direction and the second direction.

12. The liquid ejecting head according to claim 2, wherein the first extending direction and the second extending direction are inclined in mutually opposite orientations with respect to a third direction orthogonal to the first direction and the second direction.

13. The liquid ejecting head according to claim 1, wherein a spacing distance in the second direction between a first connection port and a second connection port is less than a maximum width in the second direction of the first connection port, the first connection port connecting the first return channel and the first communicating channel, and the second connection port connecting the second return channel and the first communicating channel.

14. The liquid ejecting head according to claim 13, wherein the first connection port and the second connection port make contact with each other, without overlapping each other.

15. The liquid ejecting head according to claim 1, wherein a spacing distance in the second direction between a first connection port and a second connection port is not less than a maximum width in the second direction of the first connection port, the first connection port connecting the first return channel and the first communicating channel, and the second connection port connecting the second return channel and the first communicating channel.

16. The liquid ejecting head according to claim 1, wherein the at least one descender includes a first descender connected to the first return channel and a second descender connected to the second return channel, the first descender and the second descender being adjacent to each other in the second direction;

the at least one nozzle includes a first nozzle connected to the first descender, and a second nozzle connected to the second descender, the first nozzle and the second nozzle being aligned in the second direction;

the first return channel and the second return channel are symmetrical with respect to a plane which passes a middle point between the first nozzle and the second nozzle and which is orthogonal to the second direction.

17. The liquid ejecting head according to claim 1, wherein the at least one descender includes a first descender connected to the first return channel and a second descender connected to the second return channel, the first descender and the second descender being adjacent to each other in the second direction;

the at least one nozzle includes a first nozzle connected to the first descender, and a second nozzle connected to the second descender, the first nozzle and the second nozzle being aligned in the second direction;

a middle point between a first connection port and a second connection port is arranged on a plane passing a middle point between the first nozzle and the second nozzle and orthogonal to the second direction, the first connection port connecting the first return channel and the first communicating channel, and the second connection port connecting the second return channel and the first communicating channel.

18. The liquid ejecting head according to claim 1, further comprising:

a dummy chamber arranged adjacently to the at least one pressure chamber in the second direction;

a dummy descender extending in the first direction from the dummy chamber;

a dummy return channel extending from the dummy descender in a direction crossing the first direction, wherein the at least one return channel includes a fifth return channel which is adjacent to the dummy return channel in the second direction; and at least one communicating channel includes a third communicating channel which connects the fifth return channel to the second manifold and connects the dummy return channel to the second manifold.

* * * * *